United States Patent [19]

Grote et al.

[11] Patent Number: 4,673,149

[45] Date of Patent: Jun. 16, 1987

[54] LOUDSPEAKER MOUNTING SYSTEM

[75] Inventors: Warren Grote, Florissant; Frederick R. Leu, St. Charles, both of Mo.

[73] Assignee: American Trading and Production Corporation, Baltimore, Md.

[21] Appl. No.: 848,710

[22] Filed: Apr. 7, 1986

[51] Int. Cl.[4] ..... B42F 13/00

[52] U.S. Cl. ..... 248/343; 248/27.1; 248/DIG. 6; 362/366

[58] Field of Search ..... 248/342, 27.1, 546, 248/57, DIG. 6; 52/39, 28; 362/362, 366, 365, 370, 371, 368

[56] References Cited

U.S. PATENT DOCUMENTS

| | | | |
|---|---|---|---|
| 2,305,015 | 12/1942 | Langer | 248/343 X |
| 2,787,702 | 4/1957 | Oster et al. | 362/366 |
| 2,802,933 | 8/1957 | Broadwin | 362/366 |
| 2,914,287 | 11/1959 | Henning | 248/343 |
| 2,922,030 | 1/1960 | Bobrick | 362/366 |
| 2,954,959 | 10/1960 | Kaufman et al. | 248/343 |
| 2,965,348 | 12/1960 | Gerstel et al. | 248/343 |
| 3,169,007 | 2/1965 | Duffy et al. | 248/343 |
| 4,274,615 | 6/1981 | Chan et al. | 248/343 |

*Primary Examiner*—Dennis L. Taylor

*Attorney, Agent, or Firm*—Cohn, Powell & Hind

[57] ABSTRACT

This loudspeaker mounting system provides an enclosure (10) which is intended for installation into a drywall ceiling (12). The enclosure (10) includes an upper wall (16), and an annular lower flange (18) interconnected by a cylindrical sidewall (20). The sidewall includes a circumferentially spaced generally tee-shaped slots (30) each receiving an individual support bracket member (32) having a generally ell-shaped forward portion (54) and a slotted rearward portion (56). Inwardly projecting threaded fasteners (52) are attached to the sidewall adjacent each slot (30) to receive the slotted transverse portion (56). When the bracket member forward portions (54) are inserted into the sidewall (20) the bracket members can be guided into engagement with the ceiling (12) so that the ceiling is sandwiched between the flange (18) and the individual bracket members (32).

6 Claims, 4 Drawing Figures

LOUDSPEAKER MOUNTING SYSTEM

BACKGROUND OF THE INVENTION

This invention relates generally to recessed ceiling fixture mounting systems and particularly to a system which permits installation of the loudspeaker enclosure into a ceiling avoiding direct ceiling attachment by fasteners.

Although several systems of mounting loudspeaker and light enclosures to a ceiling are known in the prior art the most common method conventionally used is to mount the enclosure rim directly to the margin of the ceiling opening by toggle bolts. This toggle mounting method is unsatisfactory for several reasons. One of these is that it requires that relatively large toggle bolt openings must be drilled in the ceiling closely adjacent to the margin of the opening which is cut into the frangible drywall ceiling to receive the enclosure. Another is that the toggle bolts tends not to be re-usable if the enclosure is relocated.

The closest known prior art is believed to be found in U.S. Pat. Nos. 2,305,015 (Langer), 2,898,075 (McGinty) and 2,954,959 (Kaufman). Langer discloses a recessed lamp housing provided with slots, each slot receiving the lower leg of an outwardly extending clip, this leg being urged into engagement with the ceiling by spreading related inwardly extending portions of the clip by a threadedly adjustable element which reduces the available space within the enclosure. McGinty discloses a recessed ceiling fixture in the form of a rectangular enclosure having relatively large and wide side openings receiving ceiling-engageable feet provided at each end of elongate brackets. The feet are tied together thereby having limited adjustment. Kaufman discloses another recessed light fixture which relies on spring-loaded interior fastener members which are space-consuming and provide a resilient rather than a secure clamp.

The present invention solves these and other problems in a manner not disclosed in the known prior art.

SUMMARY OF THE INVENTION

This ceiling fixture mounting system is particularly intended for mounting a loudspeaker enclosure into a drywall ceiling without the use of toggle bolts or other ceiling attached direct fasteners.

The system utilizes outwardly extending adjustable support bracket members which facilitate attachment of the enclosure to ceilings of variable thickness and maximizes the usable space within the enclosure.

The enclosure can be readily removed and relocated without the need for additional fasteners to accomplish the re-installation.

This recessed fixture enclosure includes an upper wall; flange means disposed in spaced relation from the upper wall and engageable with the underside of the ceiling; a peripheral sidewall extending between the upper wall and the flange means, said sidewall including a plurality of peripherally spaced slots each having a relatively narrow generally vertical leg; a plurality of individual support bracket members each including a forward portion extendable outwardly of the sidewall and having a relatively narrow vertical leg receivable by an associated sidewall slot vertical leg in guided relation and a bearing portion operatively engageable by the upper side of the ceiling, and a transverse rearward portion operatively engageable with the inside face of the sidewall and having a generally vertical slot. A plurality of inwardly extending fastener means are provided each attached to the sidewall adjacent an associated sidewall slot and received by the bracket member rearward portion slot for adjusting the location and engagement of the bracket member bearing portion relative to the ceiling.

It is an aspect of this invention to provide that each of the sidewall slots includes a relatively narrow generally horizontal leg and that each bracket member forward portion includes a generally horizontal leg providing the bearing portion, said leg being initially receivable by the sidewall slot horizontal leg.

It is another aspect of this invention to provide that each vertical leg of the spaced sidewall slots includes opposed ends and each of said sidewall slots horizontal leg is disposed between said opposed ends and to provide that each bracket member forward portion includes a generally horizontal leg integrally formed with said bracket member vertical leg.

Yet another aspect of this invention is to provide that the length of each sidewall slot vertical leg is greater than the length of the associated bracket member vertical leg and that the bracket member horizontal leg, operatively engageable with the upper side of the ceiling, is shorter than the vertical leg and clears the sidewall when the bracket member is in place.

Still another aspect of this invention is to provide that each fastener means includes a threaded shank, fixedly attached to the sidewall and extending inwardly thereof, and a wing nut for clamping the bracket member rearward portion to the sidewall.

It is another aspect of this invention to provide that each sidewall slot is generally tee-shaped and each bracket member forward portion is generally ell-shaped and is received initially within the upper portion of the tee-shaped slot.

Yet another aspect of this invention is to provide an enclosure which is relatively simple and inexpensive to manufacture and easy to install in a drywall ceiling.

DESCRIPTION OF THE PREFERRED EMBODIMENT

Figure 1:
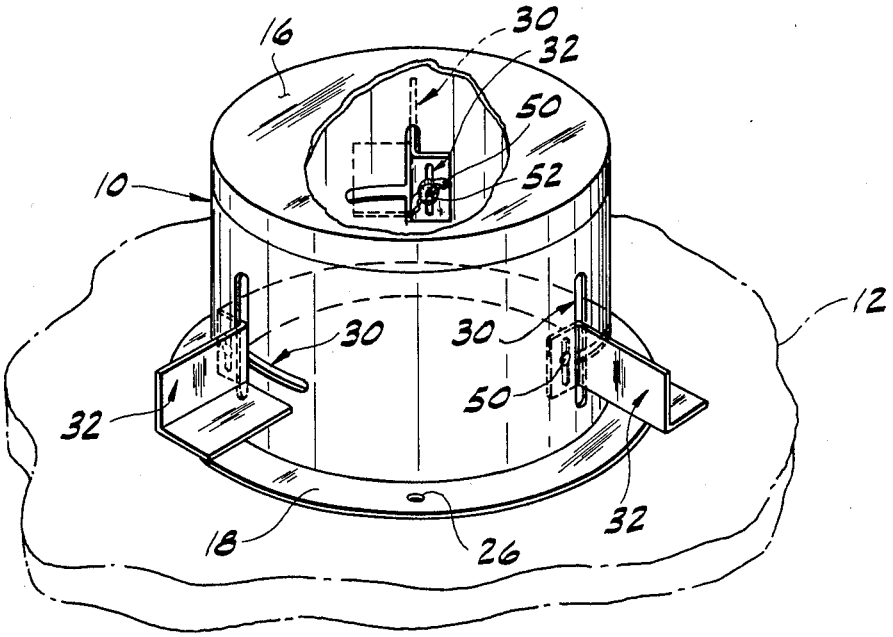
FIG. 1 is a perspective view of an enclosure from the upperside with installation almost completed.

Referring now by reference numerals to the drawing and first to FIG. 1 it will be understood that the enclosure 10 is generally cylindrical and is mounted within a precut circular opening 14 provided in a drywall ceiling 12.

The enclosure 10 includes a circular upper wall 16, an outwardly extending annular flange 18 spaced from said upper wall and interconnected to it by a cylindrical sidewall 20. The ceiling opening 14 is slightly larger in diameter than the diameter of sidewall 20 so that the inside of the flange 18 operatively engages the underside 22 of the ceiling. The flange 18 includes a plurality of circumferential spaced threaded openings 26 for mounting the loudspeaker (not shown), or other fixture such as a light fixture (not shown), to be mounted within the enclosure 10.

The sidewall 20 includes a plurality of circumferentially spaced slots 30, three in number in the preferred embodiment, which receive associated bracket members 32 intended to hold the enclosure 10 in place by engagement with the upperside 24 of the ceiling 12. The slots 30 are generally tee-shaped cut-out portions and include a narrow vertical leg 34, defined by opposed ends 38, and a narrow horizontal leg 36 disposed between the ends 38. The leg 34 is defined by a remote end 44 and a proximal end 46 opening into the vertical leg 34.

Figure 4:
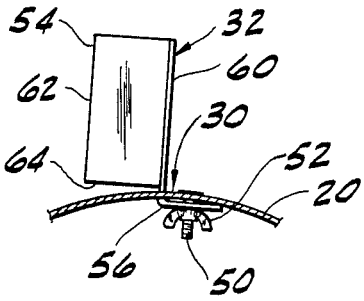
FIG. 4 is a fragmentary cross-sectional view taken on line 4—4 of FIG. 3.

As best shown in FIG. 4, a fastener means in the form of a threaded shank 50 is welded, or otherwise fixedly attached, to the sidewall 20 adjacent each vertical leg 34 in the clear area on the opposite side to the horizontal leg 36. The shank 50 receives a wing nut 52 and said shank projects inwardly of the enclosure sidewall 20.

Figure 2:
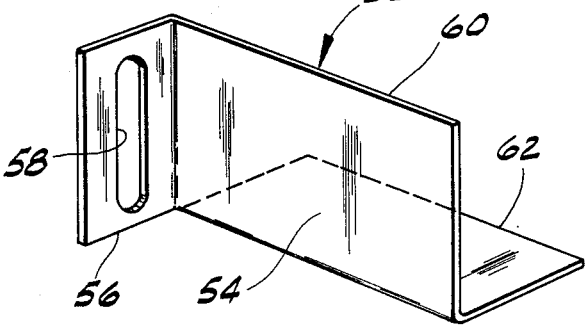
FIG. 2 is an enlarged perspective of a bracket member.

The bracket members 32 received by associated slots 30 are best shown in FIG. 2. As shown, each bracket member 32 includes a generally ell-shaped forward portion 54 and a transverse, integrally formed rearward portion 56 having a vertical slot 58. The forward portion 54 includes a vertical leg 60 shorter in height than the length of the slot vertical leg 34 and a horizontal leg 62. The horizontal leg 62 is shorter in outstanding length than the vertical leg 60, as shown in FIG. 4, so that the rear margin 64 is disposed forwardly of the bracket member transverse portion 56. The transverse portion 56, in the embodiment shown, is bent in the opposite direction to the horizontal leg 62.

Figure 3:
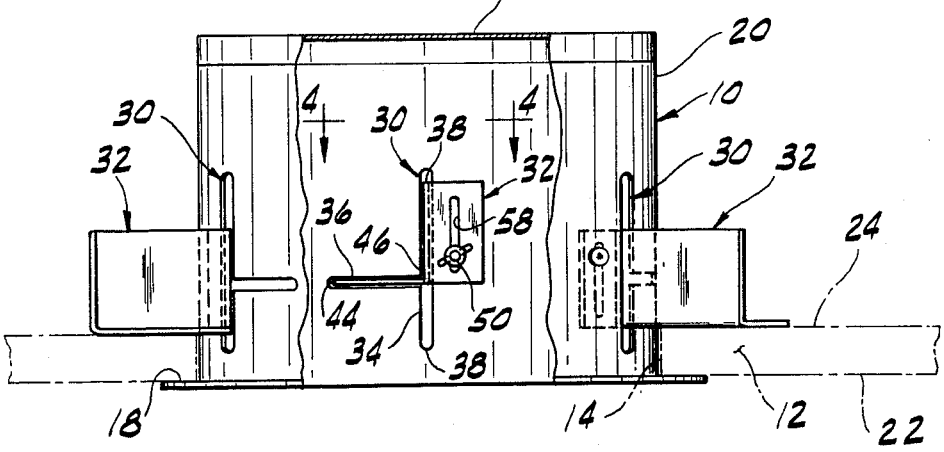
FIG. 3 is an elevational view, partly in cross section, showing the enclosure installed.

Installation of the enclosure 10 is accomplished as best shown with reference to FIGS. 3 and 4. The enclosure 10 is inserted into the ceiling opening 14 and held in place with the flange 18 pressed against the ceiling underside 22. The bracket members 32 are installed within associated slots 30, as shown by reference to the intermediate bracket member 32, by initially aligning the vertical leg 60 and horizontal leg 62 of the bracket member 32 with upper portion of the sidewall slot vertical leg 34 and horizontal leg 36 from the inside of the enclosure 10. The forward portion 54 of the bracket member 32 is then slid into the slot until the bracket member rearward portion 56 engages the inside face of the sidewall 20. As shown in FIG. 4, when this occurs, the horizontal leg 62 of the forward portion 54 is clear of the slot 30 and the fastener shank 50 is received by the slot 58 of the rearward portion 56. At this time, the bracket member is free to ride vertically in the vertical leg of slot 30 which acts to guide the bracket member. When the wing nut 52 is positioned on the shank 50, the bracket member can be moved downwardly until the leg 56 engages the the ceiling upper side 24. The wing nut 52 can then be tightened and, since the bracket rearward portion is straight and the sidewall 20 is curved, a springlike action is created which tends to hold the bracket in place.

When all bracket members 32 are in engagement with the ceiling upper side 24 the enclosure 10 is effectively held in place by cooperation between the enclosure flange 20 and the bracket members 32, which sandwich the ceiling 12 between them. It will be understood that the thickness of the bracket member 32, which is preferably unitarily formed from a single sheet of metal is such that it is slightly less than the width of the sidewall slot vertical leg 34 and horizontal leg 36. Because of this relationship the bracket member 32, when in place, is prevented from twisting and cooperates with the fastener threaded shank 50 to provide a firm connection. Further, the material removed from the sidewall to form the horizontal leg 36 is minimized to avoid weakening of the sidewall 20.

It will be understood that with the structural arrangement of parts described above, the enclosure has virtually no internal inwardly projecting parts resulting from the bracket member connection and the available enclosure usable area is at a maximum. Moreover, if it should be desired to relocate the enclosure it is simply a matter of removing the loudspeaker, loosening the wing nut 52, sliding the bracket members upwardly until the bracket member horizontal leg 62 is aligned with the horizontal slot leg 36. At this time the wing nut 52 can be removed and each bracket member 32 pulled inwardly to free it from its associated sidewall slot 30. The guide means provided by the sidewall slot vertical leg 34 in which the bracket member leg 60 rides, and the length of the slot 58, facilitates the necessary alignment of the horizontal leg and slot.

When the bracket members 32 have all been removed the enclosure 10 can be readily pulled free and, using the same bracket members 32, can easily be installed at a new location.

In view of the above it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

We claim as our invention:

1. A recessed fixture enclosure for a ceiling having an upper side and an underside, the enclosure comprising:

(a) an upper wall, (b) flange means disposed in spaced relation from the upper wall and operatively engageable with the underside of the ceiling, (c) a peripheral sidewall extending between the upper wall and the flange means, said sidewall including a plurality of peripherally spaced slots each having a relatively narrow generally vertical leg, (d) a plurality of individual support bracket members each including a forward portion extendable outwardly of the sidewall and having a relatively narrow vertical leg, receivable by an associated sidewall slot vertical leg in guided relation, and a bearing portion operatively engageable with the upper side of the ceiling, and a transverse rearward portion operatively engageable with the inside face of the sidewall and having a generally vertical slot, and (e) a plurality of inwardly extending fastener means each attached to the sidewall adjacent an associated sidewall slot and received by the bracket member rearward portion slot for adjusting the location of the bracket member bearing portion.

2. A recessed enclosure as defined in claim 1, in which:

(f) each of the spaced sidewall slots includes a relatively narrow generally horizontal leg, and (g) each bracket member forward portion includes a generally horizonta1 leg providing the bearing portion, said leg being initially receivable by the sidewall slot horizontal leg.

3. A recessed enclosure as defined in claim 1, in which:

(f) each vertical leg of the spaced sidewall slots includes opposed ends and each of said sidewall slots includes a relatively narrow horizontal leg disposed between said opposed ends, and (g) each bracket member forward portion includes a generally horizontal leg integrally formed with said bracket member vertical leg and providing the bearing portion, said horizontal leg being initially receivable by the sidewall slot horizontal leg.

4. A recessed enclosure as defined in claim 3, in which:

(h) the length of each sidewall slot vertical leg is greater than the height of the associated bracket member vertical leg, and (i) the bracket member horizontal leg operatively engageable with the upper side of the ceiling is shorter in outstanding length than the vertical leg and clears the sidewall when the bracket member is in place.

5. A recessed enclosure as defined in claim 4, in which:

(j) each fastener means includes a threaded shank fixedly attached to the sidewall on the side of the sidewall slot opposite the horizontal leg and extending inwardly thereof, and a wing nut for clamping the bracket member rearward portion to the sidewall.

6. A recessed fixture enclosure for a ceiling having an upper side and an underside, the enclosure comprising:

(a) a circular upper wall, (b) an annular flange disposed in spaced relation from the upper wall and operatively engageable with the underside of the ceiling, (c) a cylindrical sidewall interconnecting the upper wall and the annular flange, said sidewall including an inside face and an outside face and three substantially identical, equally spaced, generally tee-shaped slots each slot having a relatively narrow, generally vertical, guide leg including opposed ends, and a relatively narrow, generally horizontal leg disposed at one side of said vertical leg intermediate the ends of said vertical leg, said horizontal leg having opposed ends, one end opening into said vertical leg, (d) a plurality of individual support bracket members each associated with a sidewall slot, each bracket member including a generally ell-shaped forward portion having a vertical leg received by an associated sidewall slot vertical leg and a horizontal bearing leg initially received by an associated horizontal slot, said horizontal leg being shorter than said vertical leg and being operatively engageable with the upper side of the ceiling, and a transverse rearward portion operatively engageable with the inside face of the sidewall and having a generally vertical slot, and (e) a plurality of fastener means each including an inwardly extending threaded shank fixedly attached to the sidewall adjacent a sidewall slot vertical leg on the opposite side of the horizontal leg and receivable by the bracket member slot and a wing nut receivable by the shank for clamping the bracket member rearward portion to the sidewall inner face in adjustable relation to provide a substantially clear enclosure space.

* * * * *